US005126750A

United States Patent [19]

Wang et al.

[11] Patent Number: 5,126,750

[45] Date of Patent: Jun. 30, 1992

[54] MAGNETIC HYBRID-MODE HORN ANTENNA

[75] Inventors: Johnson J. H. Wang, Marietta; Victor K. Tripp, Tucker, both of Ga.

[73] Assignee: The United States of America as represented by the Secretary of the Air Force, Washington, D.C.

[21] Appl. No.: 588,636

[22] Filed: Sep. 21, 1990

[51] Int. Cl.[5] ..... H01Q 13/00

[52] U.S. Cl. ..... 343/786; 343/787

[58] Field of Search ..... 343/786, 787

[56] References Cited

U.S. PATENT DOCUMENTS

| | | | |
|---|---|---|---|
| 2,933,731 | 4/1960 | Foster et al. | 343/786 |
| 3,176,228 | 3/1965 | Phillips et al. | 343/787 |
| 4,477,816 | 10/1984 | Cho | 343/786 |
| 4,574,289 | 3/1986 | Henderson | 343/786 |
| 4,689,624 | 8/1987 | Kago et al. | 342/117 |
| 4,792,814 | 12/1988 | Ebisui | 343/786 |
| 4,902,988 | 2/1990 | Bruns et al. | 343/786 |
| 4,928,109 | 5/1990 | Bonebright et al. | 343/786 |

FOREIGN PATENT DOCUMENTS

| | | | |
|---|---|---|---|
| 0023933 | 2/1981 | European Pat. Off. | 343/786 |
| 0528203 | 6/1955 | Italy | 343/786 |
| 0141806 | 11/1980 | Japan | 343/786 |

OTHER PUBLICATIONS

Lee et al., "A Simple Circular Polarized Antenna: Circular Waveguide Horn Coated with Lossy Magnetic Material", IEEE Transactions on Antennas and Propagation, vol. 36, No. 2, Feb. 1988, pp. 297-300.

Wang, Johnson, J. H. et al, "Design and Performance of the Magnetic Hybrid-Mode Horn", IEEE Transactions on Antennas and Propagation, vol. 37, No. 11, Nov. 1989, pp. 1407-1414.

Wang, J. J. H. et al, "Magnetically coated horn for low sidelobes and low cross-polarisation", IEEE Proceedings, vol. 136, Pt. H. No. 2, Apr. 1989, pp. 132-138.

*Primary Examiner*—Rolf Hille
*Assistant Examiner*—Hoanganh Le
*Attorney, Agent, or Firm*—William G. Auton; Donald J. Singer

[57] ABSTRACT

A magnetic corrugated horn antenna system is disclosed. This system includes a magnetic hybrid-mode horn antenna composed of a circular waveguide and a corrugated horn antenna which has a thin magnetic coating on its inner wall. The corrugation of the conical horn helps it to produce equal E-plane and H-plane patterns with low sidelobes. The magnetic coating can enhance or duplicate the beneficial effects of the corrugation, while avoiding the high gain loss and poor patterns reported in prior art systems that relay only on corrugated horns.

3 Claims, 9 Drawing Sheets

MAGNETIC HYBRID-MODE HORN ANTENNA

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to radar antennas, and more specifically the invention pertains to a microwave corrugated horn antenna system which uses a magnetic coating to enhance its radiation pattern.

The combination of a parabolic or partially parabolic reflector illuminated by a horn antenna is one of the earliest antenna system arrangements employed in radar systems for the generation of a highly directive beam in space, and accordingly is extensively described in the technical literature. The text "Antenna Engineering Handbook," Henry Jasik, Editor (McGraw-Hill 1961) provides an overview of the art in that respect.

Exemplary examples of conical antenna systems are described in the following U.S. Patents, the disclosures of which are incorporated herein by reference:

U.S. Pat. No. 4,477,816 issued to Cho;

U.S. Pat. No. 4,792,814 issued to Ebisui;

U.S. Pat. No. 3,631,502 issued to Peters et al; and

U.S. Pat. No. 4,928,109 issued to Bonebright et al.

The Cho and Peters et al. patents disclose corrugated antenna feed horn systems that could be improved by the present invention. The Ebisui reference discloses a conical horn antenna which uses plural modes of electromagnetic waves. The Bonebright et al. reference discloses a non-magnetic electrically conducting radiating horn antenna.

Also of interest are publications entitled "Magnetically Coated Horn for Low Sidelobes and Low Cross-Polarization," *IEE Proceedings*, Vol. 136, Pt. H. No. Apr. 2, 1989, pages 132 through 138, and "Design and Performance of the Magnetic Hybrid-Mode Horn," *IEEE Transactions on Antennas and Propagation*, Vol. 37, No. Nov. 11, 1989, pages 1407 through 1414. These articles suggest a use of magnetic coatings on antennas to enhance the circular polarization radiation performance. These articles are specifically incorporated herein by reference.

Many corrugated horn antennas have large weight and stringent mechanical tolerances, and are therefore impractical or expensive in most application. The present invention overcomes these limitations. As compared with the previously reported coated horn system, the present invention overcomes the deficiencies of high gain loss and poor patterns.

SUMMARY OF THE INVENTION

The present invention includes a magnetic hybrid-mode horn antenna composed of a circular waveguide and a corrugated horn antenna which has a thin magnetic coating on its inner wall. The corrugation of the conical horn helps it to produce equal E-plane and H-plane patterns with low sidelobes. The magnetic coating can enhance or duplicate the beneficial effects of the corrugation, while avoiding the high gain loss and poor patterns reported in prior art systems that rely only on corrugated horns.

One embodiment of the invention includes: a waveguide, a corrugated horn antenna housing, and a magnetic coating which is fixed to the inner wall of the corrugated horn antenna housing. The circular waveguide receives and conducts transverse electromagnetic radio frequency signals. The corrugated horn antenna housing is fixed to the waveguide and receives the transverse electromagnetic radio frequency signals therefrom.

The corrugated horn antenna housing has a tapered throat section and a hollow body with a plurality of uniformly spaced corrugation elements which are perpendicular to the direction of radiation of the radiated electromagnetic waveform. As discussed below, corrugation elements induce an excitation of an $HE_{11}$ mode in the electromagnetic waveform to adjust the E-plane and H-plane patterns. However, the effect of the corrugation elements is enhanced by the interaction of the magnetic coating on the inner walls of the horn antenna housing. Therefore, to attain sufficient equalization of E-plane and H-plane patterns, one does not need to add additional corrugation elements one can add a magnetic coating which weighs less than additional elements.

It is an object of the present invention to provide a corrugated horn antenna system with reduced Weight than other systems currently in use.

It is another object of the present invention to provide a corrugated horn antenna system which is insensitive to mechanical tolerances, especially in the case of the taper and the serration of the corrugation.

These objects together with other objects, features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes a magnetic hybrid-mode horn antenna composed of a circular waveguide and a corrugated horn antenna which has a thin magnetic coating on its inner wall.

In comparison with the corrugated antennas presently used, some advantages of the present invention are as follows: (1) it has a lower weight, (2) it is less costly to manufacture, (3) it is very insensitive to mechanical tolerances, especially in the case of the taper and serration mode-converters.

Figure 1:
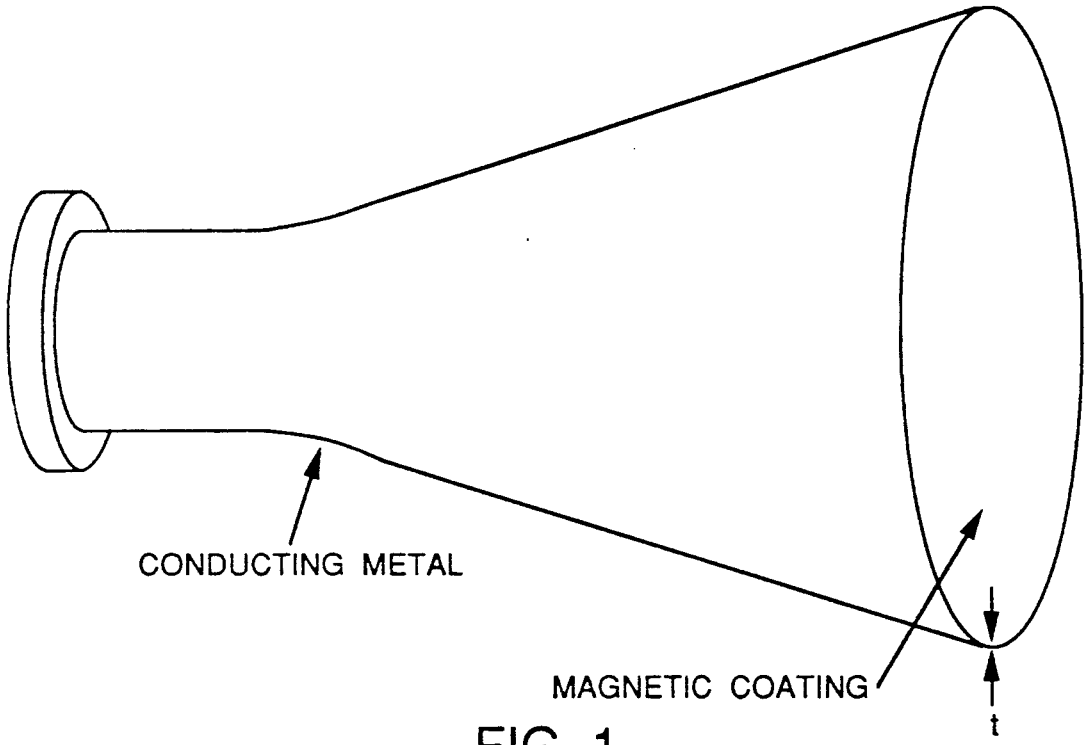
FIG. 1 is a side view of a horn antenna.

The magnetic hybrid-mode (MHM) horn antenna is a conical horn antenna with its inner wall coated with a thin layer of lossy magnetic material, as shown in FIG. 1. The MHM horn is designed to achieve the performance of the corrugated circular horns that is, to have equal E and H plane patterns, low side lobes, and low cross polarization. This performance is due to the excitation of a pure $HE_{11}$ mode at the horn aperture. However, the corrugated horn has large weight, high cost, and stringent mechanical tolerance. The present invention can be shown to be more practical and useful than the corrugated horn in these aspects.

Figure 3:
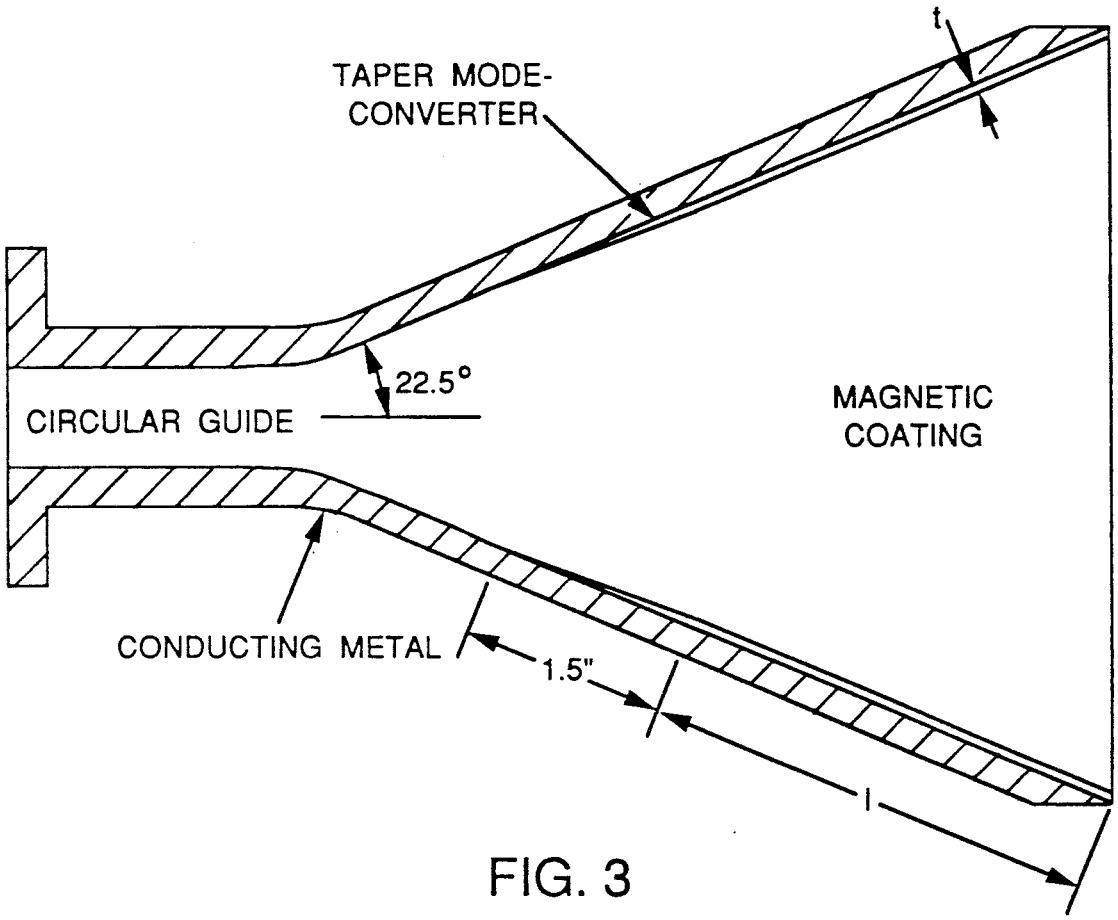
FIG. 3 is a side view of a horn antenna with a tapered magnetic coating.
Figure 4:
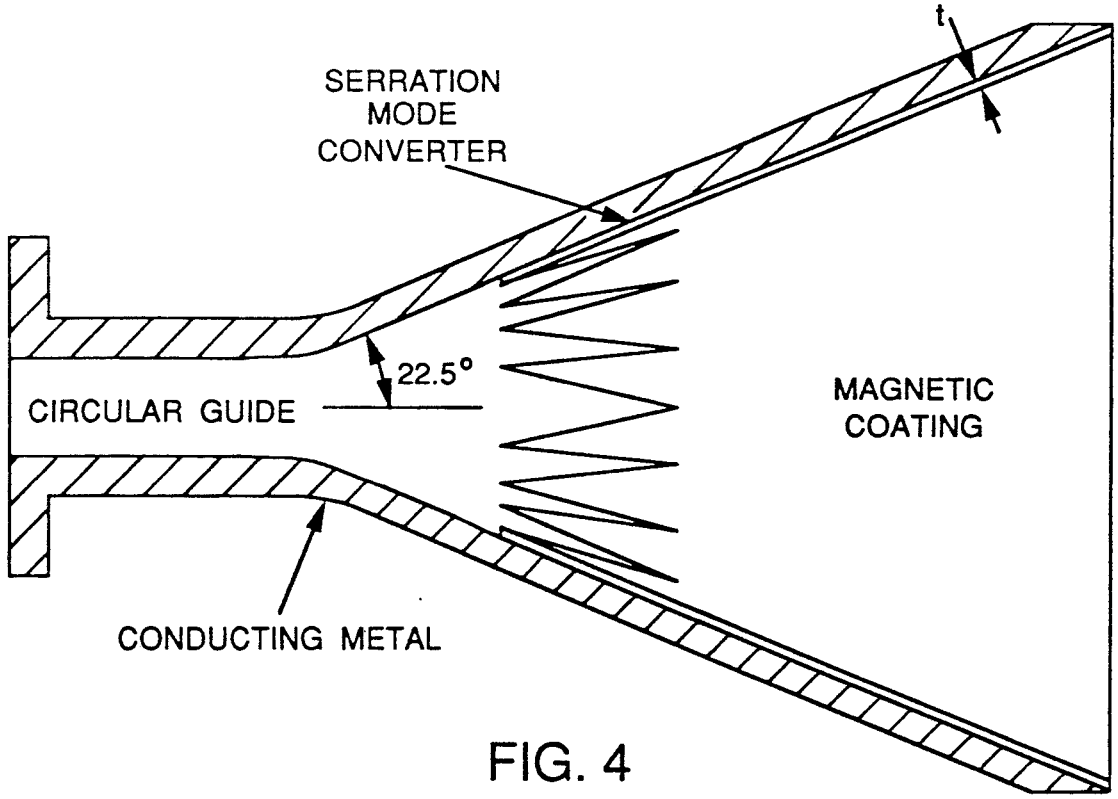
FIG. 4 is a side view of a horn antenna with a serration mode converter element and a magnetic coating.
Figure 5:
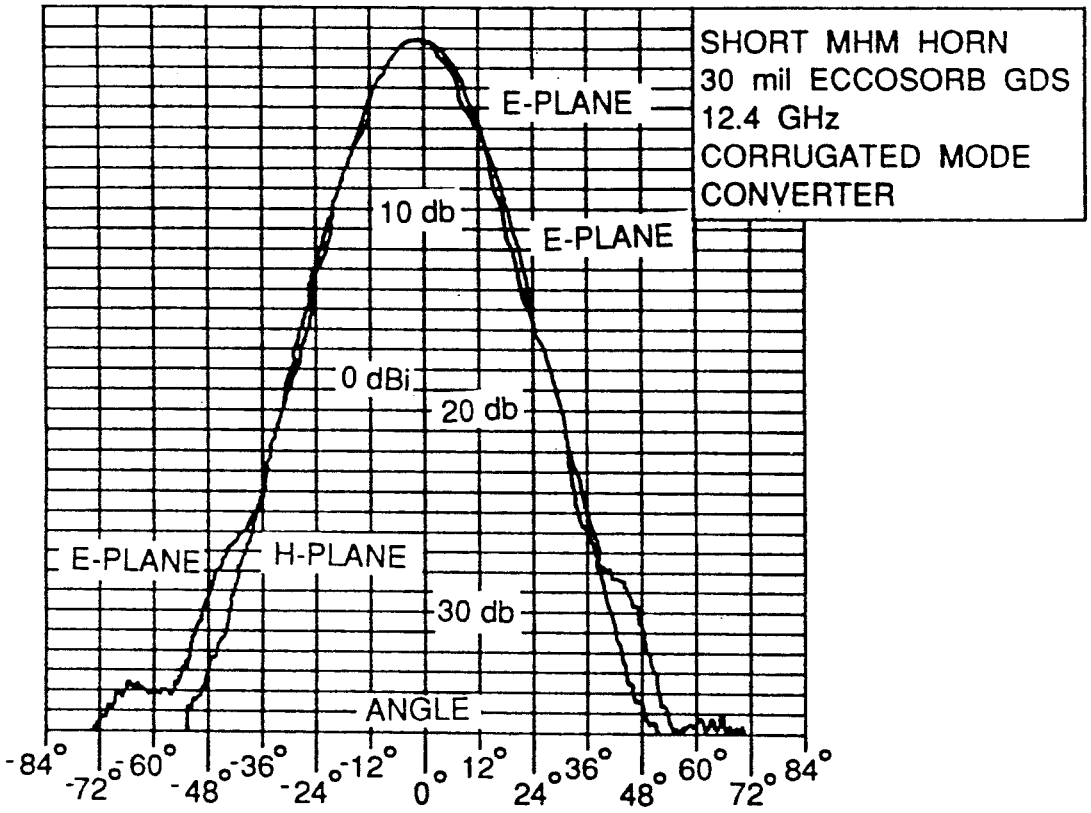
FIGS. 5–8 are charts of the radiated electromagnetic waveform characteristics of the system of FIG. 2.
Figure 6:
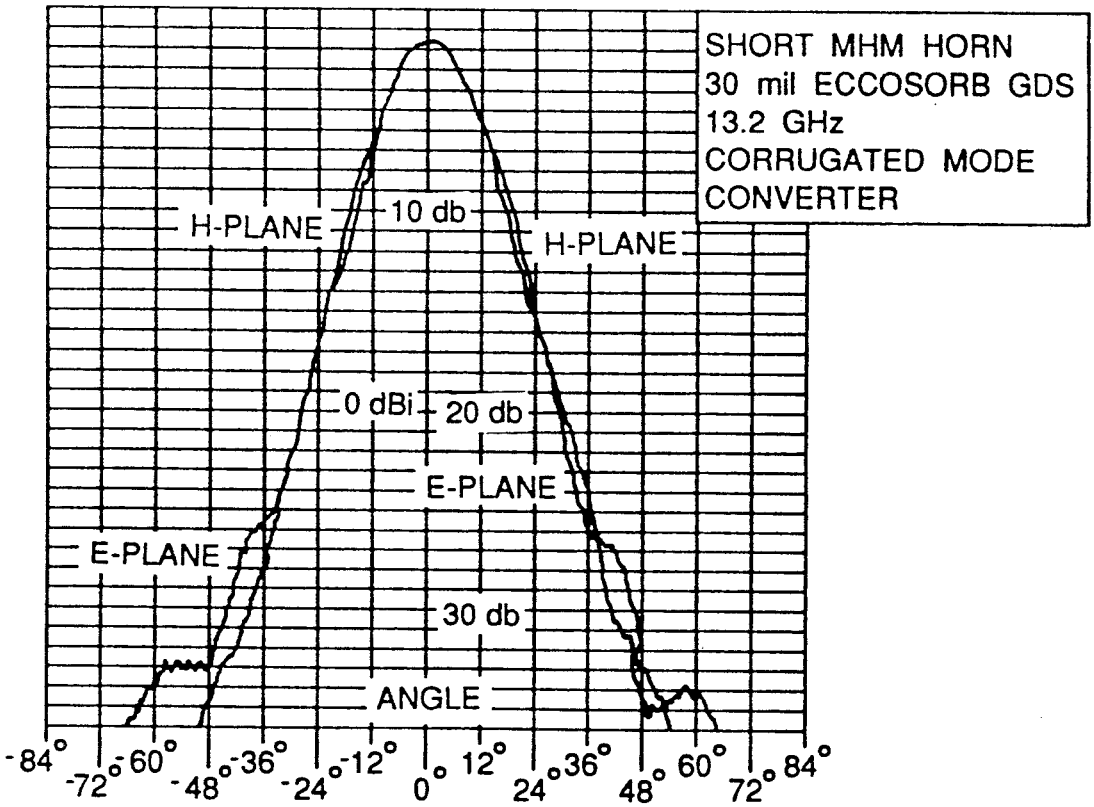
Figure 7:
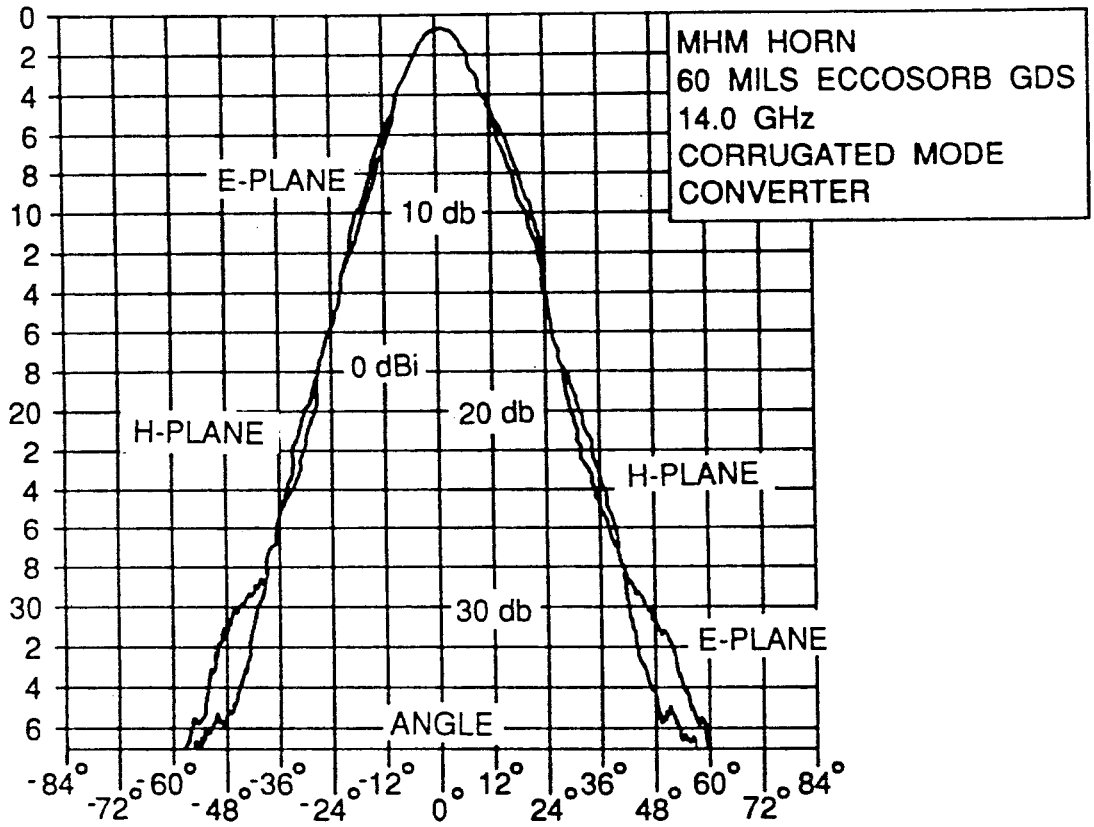
Figure 8:
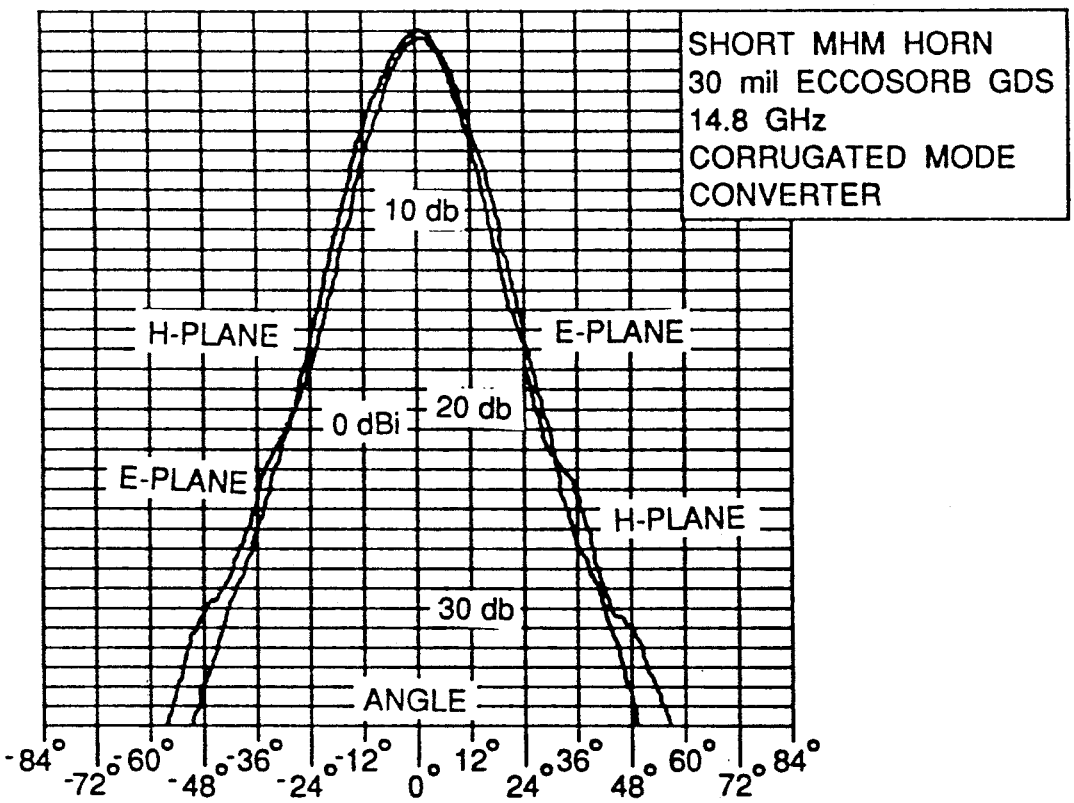

In the present invention, a mode-conversion section transforming an $HE_{11}$ mode is added near the throat of the horn. As a result, the gain loss is reduced to about 1 to 2 ½ dB, and the radiation patterns are of good quality, comparable to those of a well-designed corrugated horn. Three types of mode converters were successfully designed and tested. The MHM horns with each of the three mode converters are shown in FIGS. 2 to 4.

FIG. 1 shows the general structure of the MHM horn antenna. The circular horn fed by a circular waveguide is made of a highly conductive metal, such as brass or aluminum. A thin layer of magnetic coating is placed on the inner surface of the horn. The coating must be a highly lossy magnetic material; that is, the imaginary part of the complex permeability must be high. ECCOSORB GDS made by Emerson & Cuming, which has a measured complex relative permittivity of 10.8-j 0.4 and a measured complex relative permeability of 0.8-j1.2 at 14 GHz is used as the lossy magnetic coating. The thickness of the coating, t, is not critical, but we have observed that in most cases either a 30-mil thickness or a 60-mil thickness is satisfactory. Any thicknesses around or between 30 and 60 mils should also work.

The horn was designed for a frequency range of 12.4-14.8 GHz. We have observed that broader bandwidths are quite feasible. The flare angle of the horn, being 22.5° in FIGS. 2 to 4, can be changed to obtain various antenna beamwidths as desired. The length of the horn and the aperture diameter (4.75-inch in the figures) can also be varied to achieve different beamwidths. For different frequencies, the dimensions in the designs can be scaled up or down to maintain the same electric dimensions.

Figure 2:
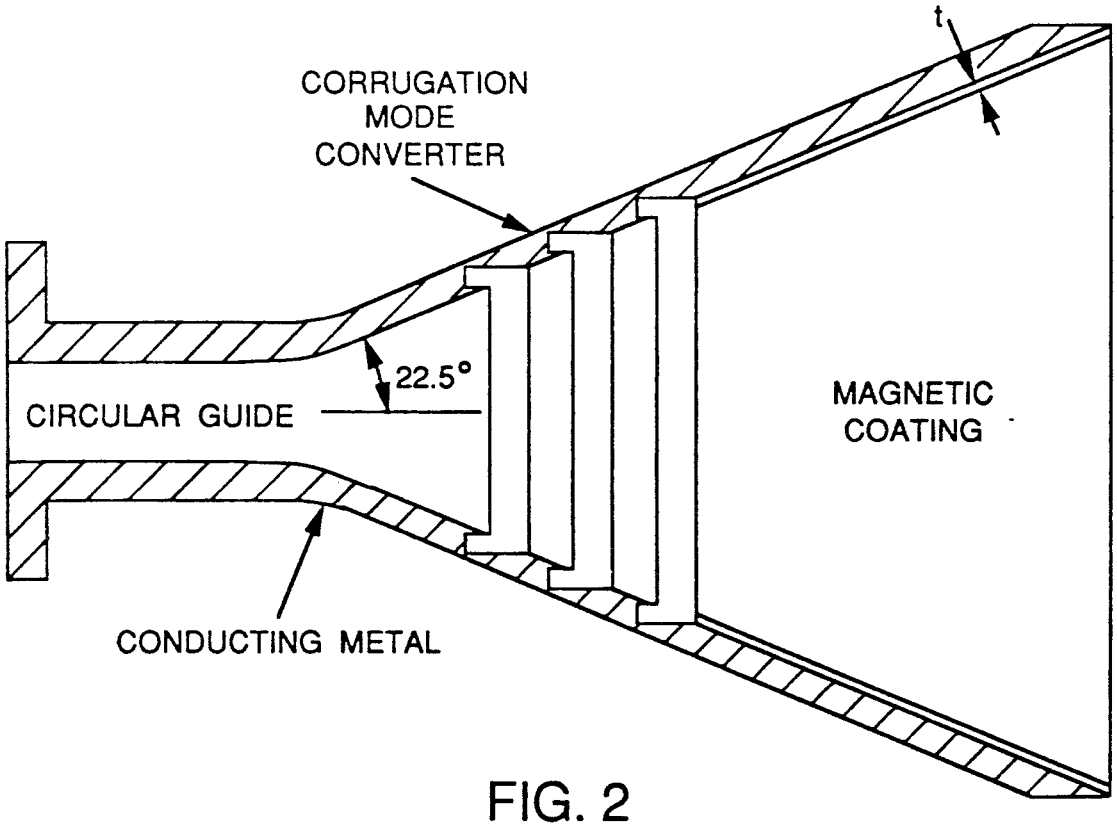
FIG. 2 is a side view of a horn antenna with corrugation mode converter elements.

In FIG. 2, the corrugation mode-converter is similar to that used in a corrugated horn. The design principle is to use the corrugation mode-converter to transform the $H_{11}$ mode in the circular guide section to an $HE_{11}$ mode, which can propagate in the magnetically coated section with little attenuation and distortion before radiation into the free space.

As shown in FIG. 3, the corrugation mode-converter is replaced by a taper mode-converter. The thickness of the ECCOSOR magnetic layer is increased from zero near the throat of the horn to a thickness t in the uniform region about 1.0 to 1.5 inches away. The length of the taper is not critical, being about on waveguide wavelength.

Figure 9:
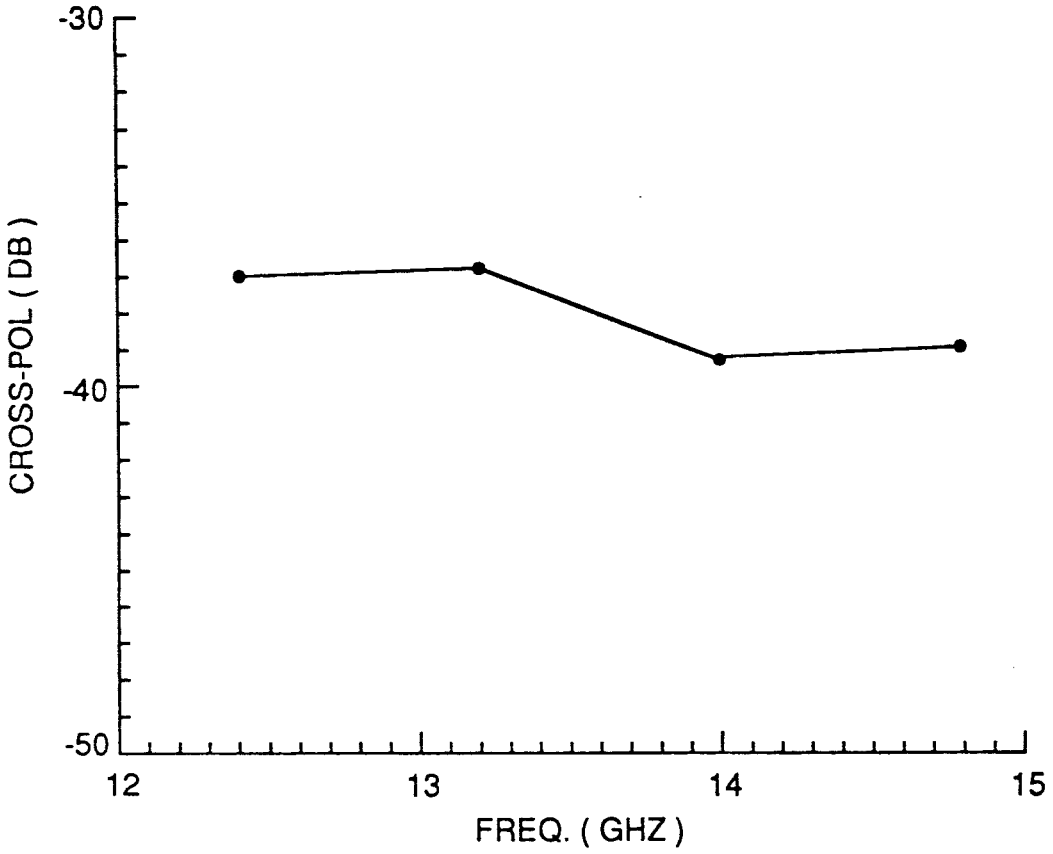
FIG. 9 is a chart of the cross polarization characteristics of a short horn antenna system.
Figure 10:
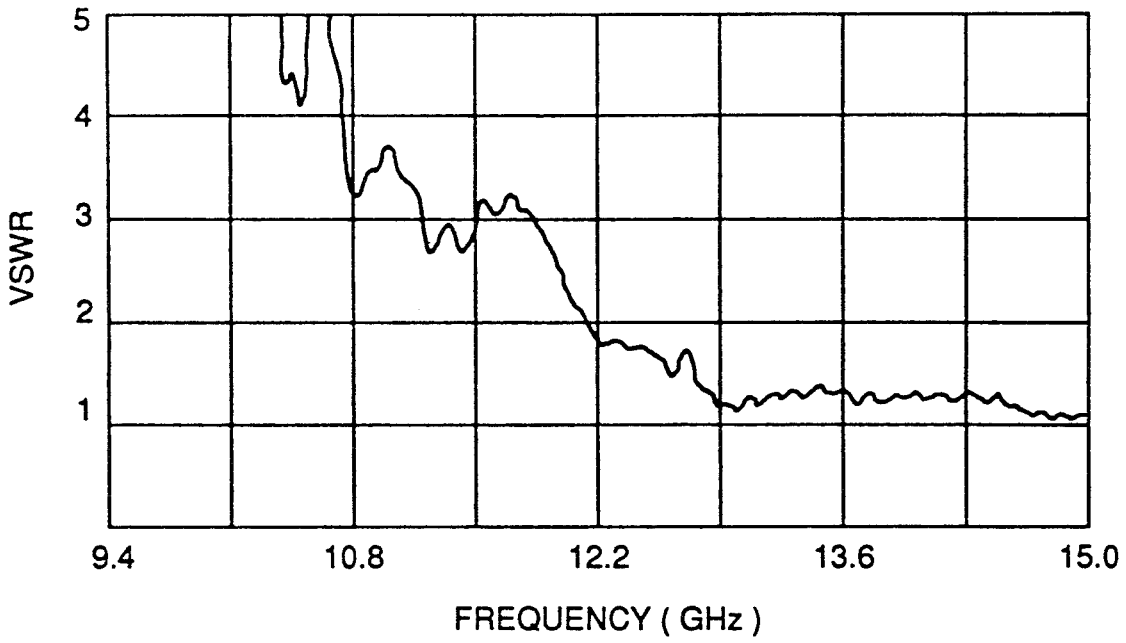
FIG. 10 is a chart of VSWR versus frequency for a short horn antenna system.
Figure 11:
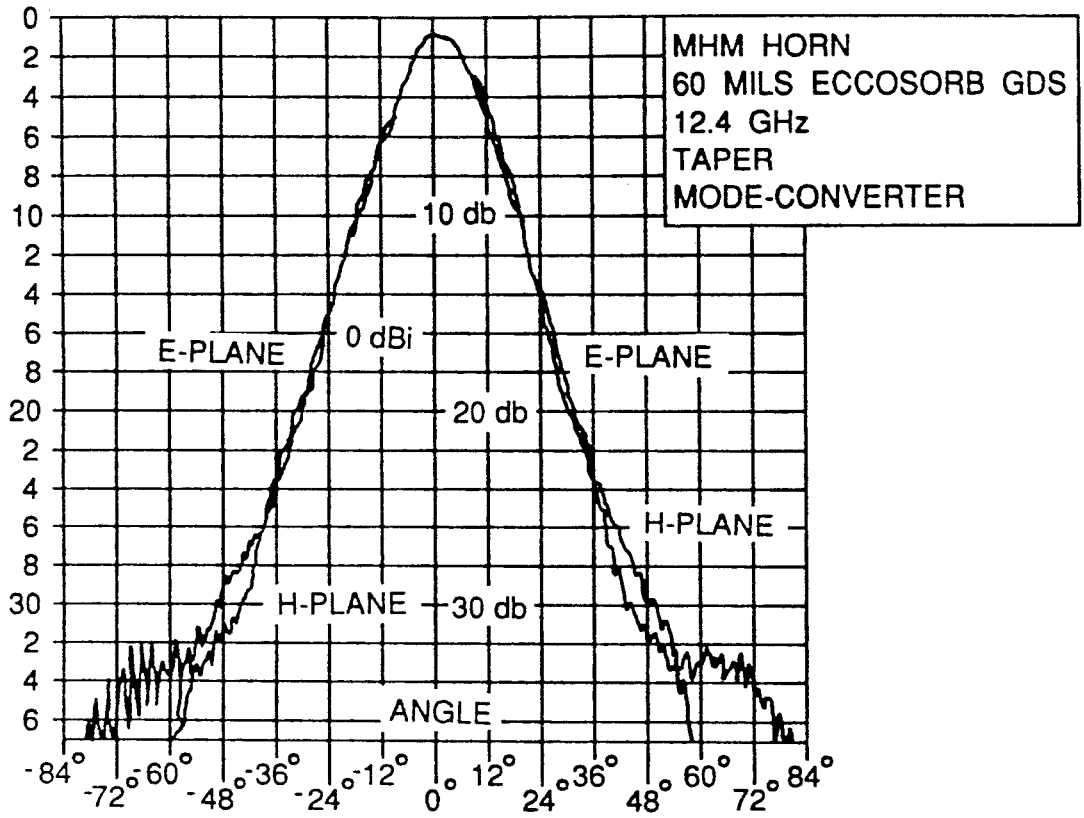
FIGS. 11–14 are charts of the radiated electromagnetic waveform characteristics of the antenna of FIG. 3.
Figure 12:
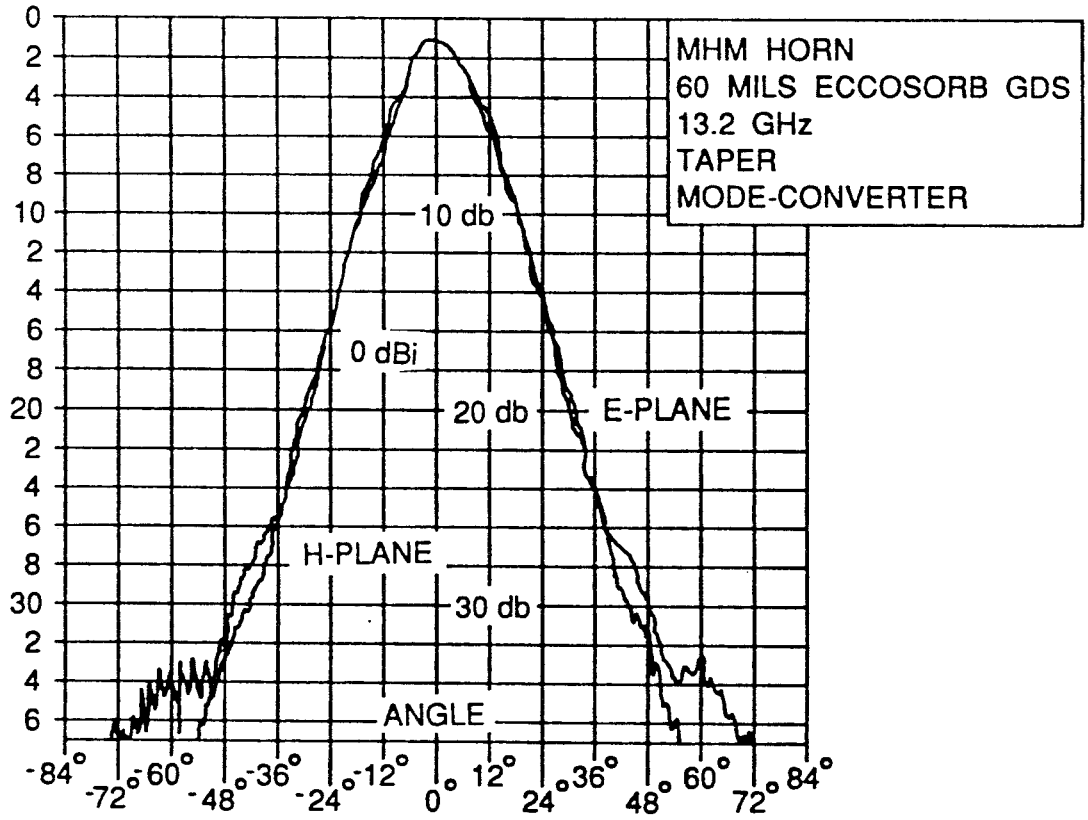
Figure 13:
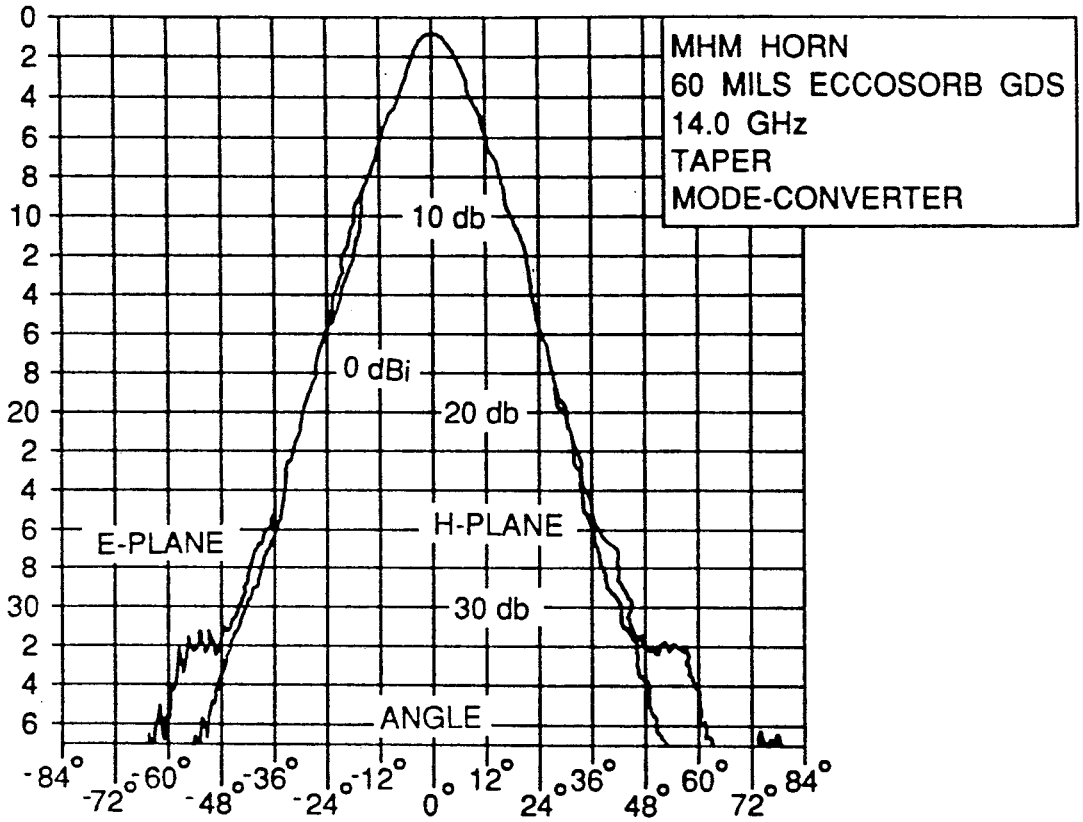
Figure 14:
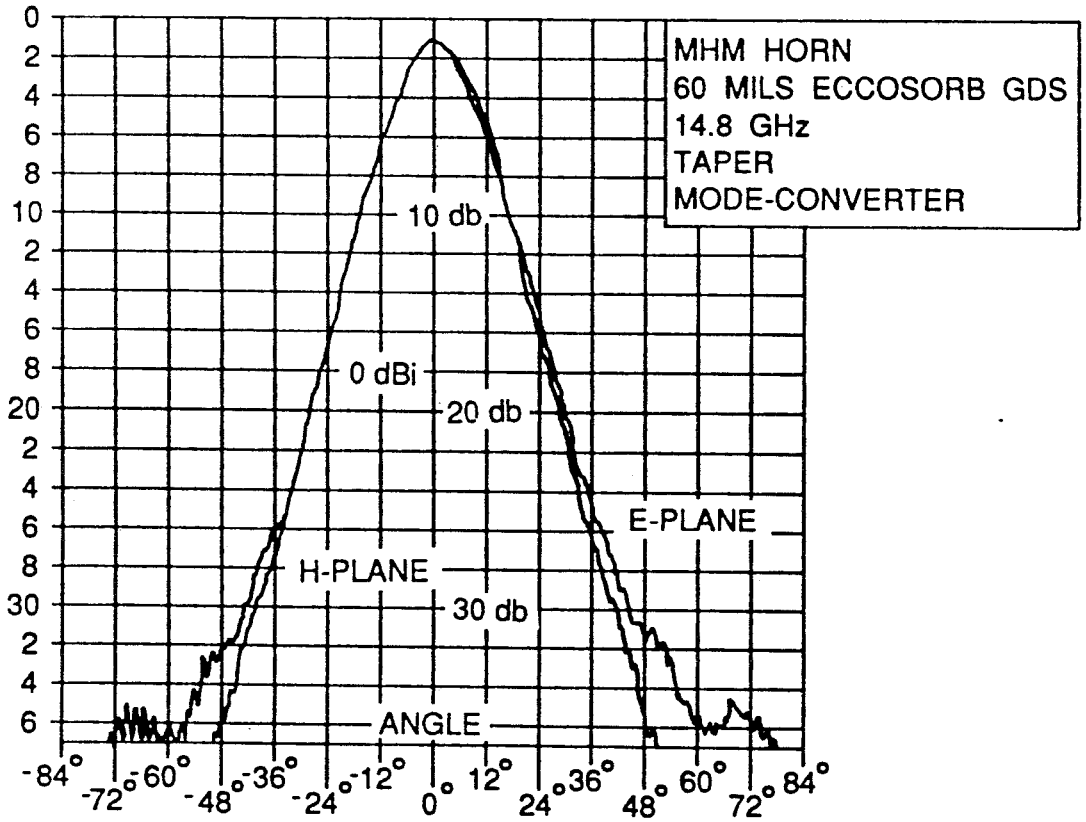
Figure 15:
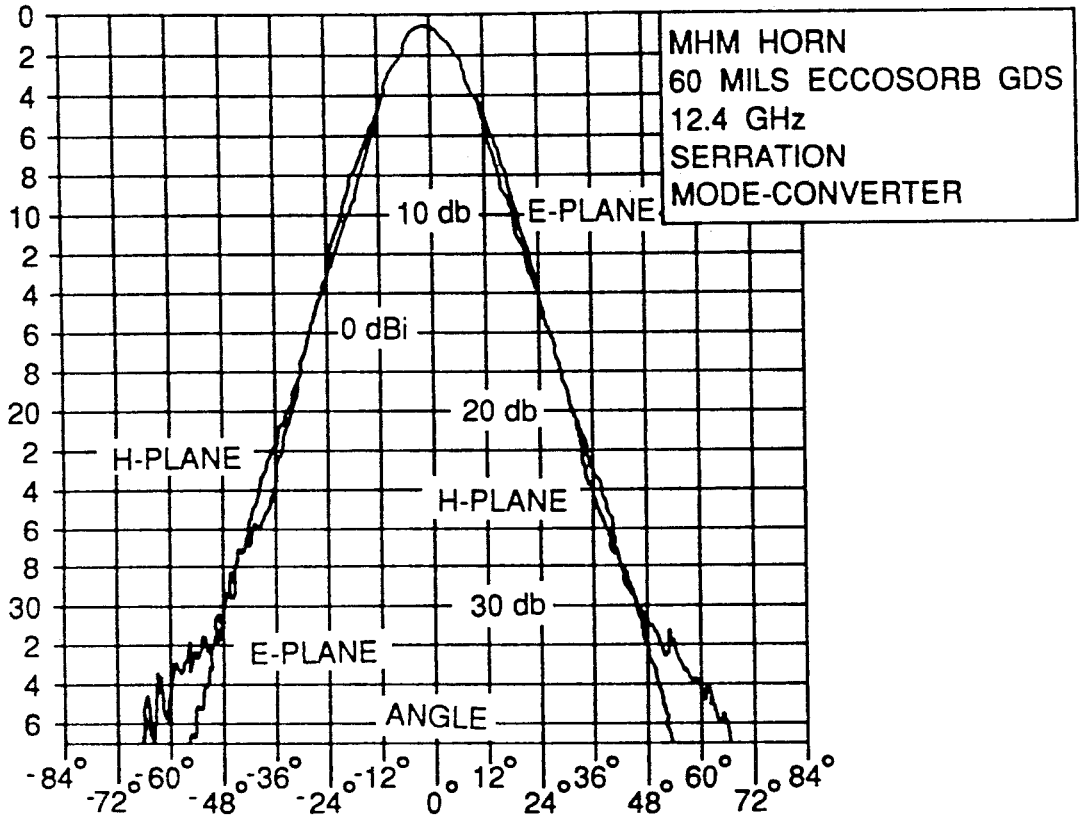
FIGS. 15–18 are charts of the radiated electromagnetic waveform characteristics of the antenna of FIG. 4.
Figure 16:
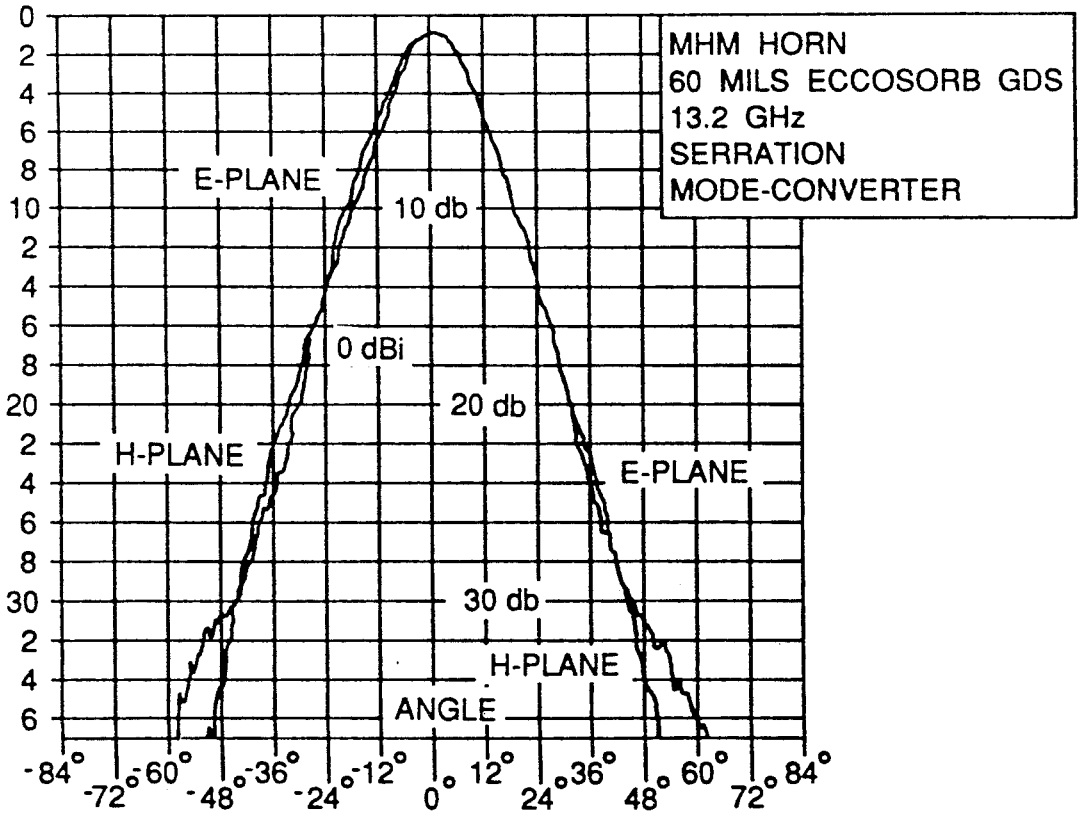
Figure 17:
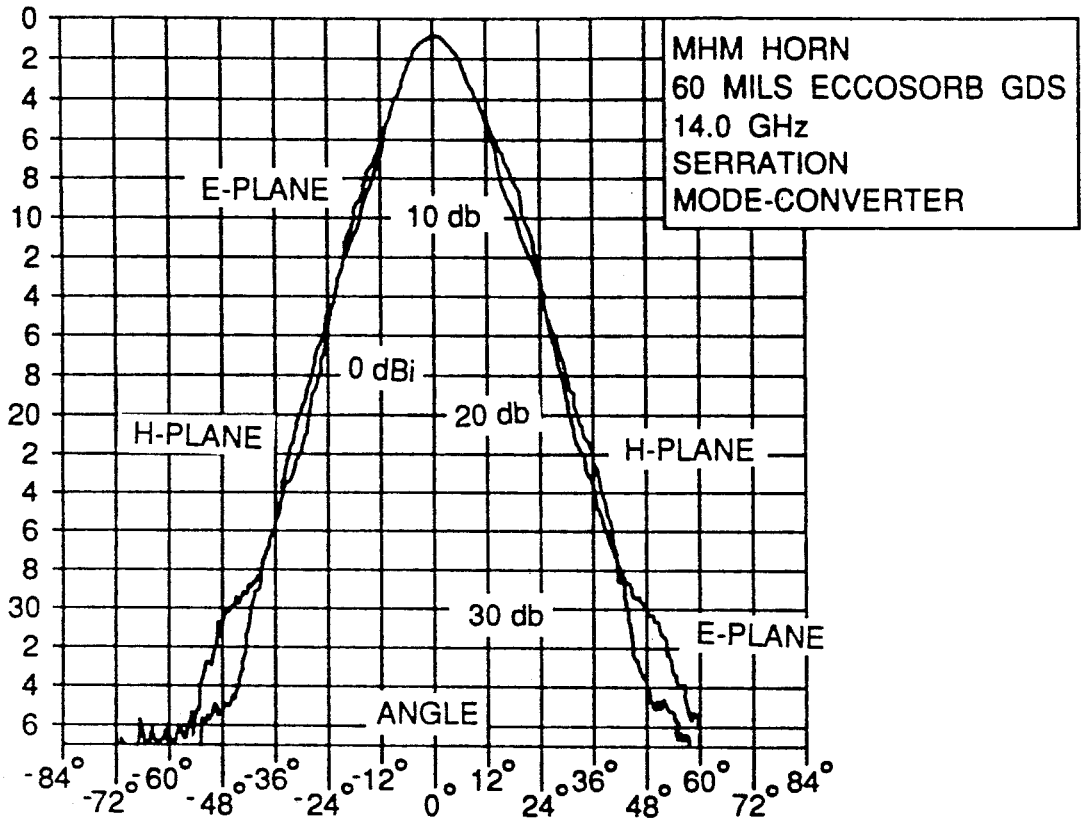
Figure 18:
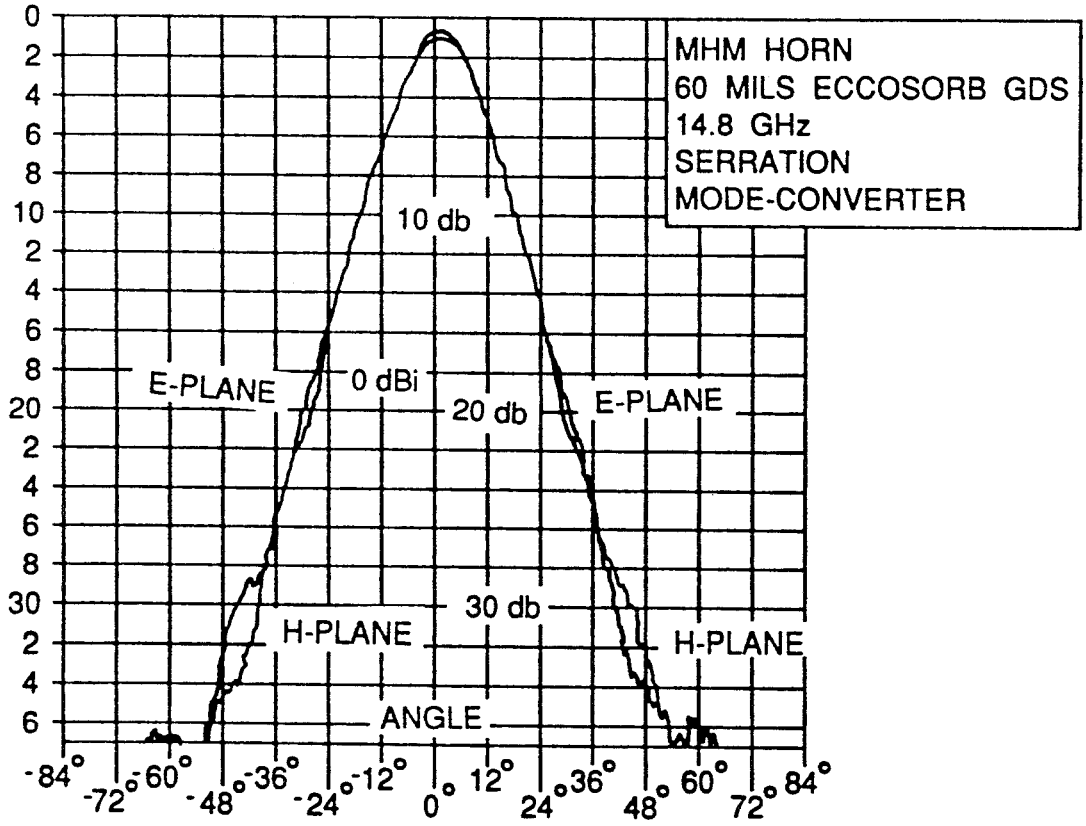

A number of MHM horns based on the aforementioned principles have been fabricated, and their antenna patterns, voltage standing wave ratio (VSWR) and cross-polarization have been tested. FIGS. 5 to 8 show the measured radiation patterns for the corrugation MHM horn of FIG. 2 with t=30 mil. The measured cross-polarization and VSWR versus frequency for this horn are shown in FIGS. 9 and 10 respectively. As can be seen, they are comparable to those of the corrugated horn.

The measured radiation patterns for the MHM horn with a taper mode-converter as shown in FIG. 3 are exhibited in FIGS. 11 to 14. The measured radiation patterns for the MHM horn with a serration mode-converter as shown in FIG. 4 are exhibited in FIGS. 15 to 18. The converter element has serrations of the magnetic coating. As can be seen, the equal E and H beamwidth, low cross-polarization, and good impedance matching as shown in FIGS. 5 to 18 are comparable to those of the corrugated horns.

In addition to the three horns with the same exterior dimensions indicated by the 22.5° flare angle and 4.75-inch aperture diameter, horns with larger aperture were also designed, fabricated, and tested. The larger horns have a narrower beamwidth and comparable performances with respect to the smaller ones. For example, the larger corrugation MHM horn has a 10 dB beamwidth of about 30° at 14.8 GHz, while the smaller one has a 10 dB beamwidth of about 36°.

The antenna gains of these MHM horns were measured by comparing with that of a standard-gain horn (having a known gain). The directivities were computed by numerical integration of the measured radiation patterns. The efficiency, $\eta$, of the antenna is ordinarily defined as $$\eta = G/D \quad (1)$$

where G and D denote the gain and directivity of the antenna under consideration.

Table 1 shows the efficiency of the three basic MHM horns of FIGS. 2 to 4. The gain, directivity, and antenna loss are expressed in dB, and the efficiency is expressed in units according to Equation 1. This efficiency is remarkably greater than that in the referenced publication of Lee, et al. (10 dB loss means $\eta=0.1$). This high efficiency and the pattern symmetry clearly demonstrate the value of this invention.

TABLE 1

Directivity Gain and Efficiency of three MHM Horn Configurations

| Frequency (GHz) | Directivity (dB) | Gain (dB) | Loss (dB) | Efficiency |
|---|---|---|---|---|
| CASE 1 CORRUGATION MODE CONVERTER, 30 MILS | | | | |
| 12.4 | 18.4 | 16.8 | 1.6 | 0.69 |
| 13.2 | 18.9 | 17.1 | 1.8 | 0.66 |
| 14.0 | 19.2 | 18.0 | 1.2 | 0.76 |
| 14.8 | 19.7 | 17.8 | 1.9 | 0.65 |
| CASE 2 TAPER MODE CONVERTER, 60 mils | | | | |
| 12.4 | 18.8 | 16.1 | 2.7 | 0.54 |
| 13.2 | 18.9 | 16.6 | 2.3 | 0.59 |
| 14.0 | 19.1 | 17.3 | 1.8 | 0.66 |
| 14.8 | 19.4 | 17.6 | 1.8 | 0.66 |
| CASE 3 SERRATION MODE CONVERTER, 60 MILS | | | | |
| 12.4 | 18.5 | 16.3 | 2.2 | 0.60 |
| 13.2 | 18.7 | 16.8 | 1.9 | 0.65 |
| 14.0 | 18.8 | 17.5 | 1.3 | 0.74 |
| 14.8 | 19.0 | 18.2 | 0.8 | 0.83 |

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A magnetic hybrid-mode antenna system comprising:

a waveguide which receives and conducts transverse electromagnetic radio frequency signals;

a corrugated horn antenna housing which has an inner wall, and which is fixed to said waveguide to receive said transverse electromagnetic radio frequency signals therefrom, said corrugated horn antenna housing radiating an electromagnetic waveform into space, said electromagnetic waveform having an E-plane pattern and an H-plane pattern; and a thin magnetic coating fixed on the inner wall of said corrugated horn antenna housing to adjust the E-plane and H-plane patterns of said electromagnetic waveform so that they are approximately equal by inducing an excitation of $HE_{11}$ mode in the electromagnetic waveform to adjust said E-plane and H-plane patterns, wherein said thin magnetic coating has a thickness ranging between 30 and 60 mils, and wherein said thin magnetic coating has a complex relative permittivity of about 10.8-j0.4 and a complex relative permeability of about 0.8-j1.2.

2. A magnetic hybrid-mode horn antenna system comprising:

a waveguide which receives and conducts transverse electromagnetic radio frequency signals;

a tapered throat which is connected to said waveguide to receive said transverse electromagnetic radio frequency signals therefrom;

a hollow body which has an inner wall and which is fixed to said tapered throat and which expands with a flare angle as one proceeds away from said tapered throat, said flare angle permitting said hollow body to radiate said electromagnetic waveform in the direction of radiation into free space;

a serration mode converter element which is fixed in said hollow body, and which induces said excitation in said electromagnetic waveform to adjust said E-plane and H-plane patterns; and a thin magnetic coating which is fixed to said inner wall of said hollow body, said magnetic coating interacting with said electromagnetic radio frequency signals so that said E-plane and H-plane patterns are adjusted as desired when said electromagnetic waveform is radiated into free space, wherein said thin magnetic coating has a thickness ranging between 30 and 60 mils said converter element having serrations of said magnetic coating.

3. A magnetic hybrid-mode antenna system, as defined in claim 2, wherein said thin magnetic coating has a complex relative permittivity of about 10.8-j0.4 and a complex relative permeability of about 0.8-j1.2.

* * * * *